US005934254A

United States Patent [19]

Vetters et al.

[11] Patent Number: 5,934,254

[45] Date of Patent: Aug. 10, 1999

[54] TOP STOP ASSEMBLY FOR A FUEL INJECTOR

[75] Inventors: Daniel K. Vetters; Bruce E. Varney, both of Columbus; Daniel K. Hickey, Greenwood, all of Ind.

[73] Assignee: Cummins Engine Company, Inc., Columbus, Ind.

[21] Appl. No.: 09/049,379

[22] Filed: Mar. 27, 1998

[51] Int. Cl.[6] ..... F02M 55/02

[52] U.S. Cl. ..... 123/470

[58] Field of Search ..... 123/470, 509, 123/468–9

[56] References Cited

U.S. PATENT DOCUMENTS

| | | | |
|---|---|---|---|
| 4,206,725 | 6/1980 | Jenkel et al. | 123/470 |
| 4,306,681 | 12/1981 | Laitio et al. . | |
| 4,519,372 | 5/1985 | Hoffman . | |
| 4,601,086 | 7/1986 | Gerlach . | |
| 5,299,738 | 4/1994 | Genter et al. . | |
| 5,329,906 | 7/1994 | Jensen et al. | 123/470 |
| 5,441,027 | 8/1995 | Buchanon et al. . | |
| 5,503,128 | 4/1996 | Hickey et al. | 123/470 |
| 5,566,658 | 10/1996 | Edwards et al. . | |
| 5,676,114 | 10/1997 | Tarr et al. . | |
| 5,685,272 | 11/1997 | Paul et al. . | |
| 5,697,345 | 12/1997 | Genter et al. | 123/470 |
| 5,706,786 | 1/1998 | Stephanus et al. | 123/470 |
| 5,730,101 | 3/1998 | Aupperle | 123/470 |
| 5,870,995 | 2/1999 | Stockner et al. | 123/470 |

FOREIGN PATENT DOCUMENTS

| | | |
|---|---|---|
| 0133470 | 2/1985 | European Pat. Off. . |
| 3141547 | 5/1983 | Germany . |
| 9304275 | 3/1993 | WIPO . |

*Primary Examiner*—Thomas N. Moulis
*Attorney, Agent, or Firm*—Sixbey, Friedman, Leedom & Ferguson; Charles M. Leedom, Jr.; Tim L. Brackett, Jr.

[57] ABSTRACT

A top stop assembly for a fuel injector is provided which includes a top stop housing having a threadless injector engaging portion positioned at one end of the housing for threadlessly engaging the outer diameter portion of an injector barrel to minimize inward bore distortion. The top stop is preferably formed integrally on the top stop housing body to create a predetermined axial length of the housing which defines a predetermined outer limit of a retraction stroke of an injector plunger assembly, i.e. a top stop position. The top stop position is set by selecting a top stop housing having a predetermined axial length corresponding to the desired top stop position thereby reducing costs and avoiding loosening problems associated with multi-part top stop assemblies.

20 Claims, 3 Drawing Sheets

TOP STOP ASSEMBLY FOR A FUEL INJECTOR

TECHNICAL FIELD

The present invention relates generally to load distributing devices for transmitting a clamping load from a clamping device to a fuel injector while functioning to stop the outward movement of a fuel injector plunger assembly.

BACKGROUND OF THE INVENTION

Many internal combustion engines, whether compression ignition or spark ignition engines, are provided with fuel injection systems to satisfy the need for precise and reliable fuel delivery into the combustion chamber of the engine. Such precision and reliability is necessary to address the goals of increasing fuel efficiency, maximizing power output, and controlling the undesirable by-products of combustion.

A fuel injector is a precision device that must meter the quantity of fuel required for each cycle of the engine and must develop the high pressure necessary to inject the fuel into the combustion chamber at the correct instant of the operating cycle. Many fuel injectors utilize a mechanical linkage from the engine, such as a push rod and rocker arm, to pressurize the fuel charge and obtain the desired fuel spray pattern. It is desirable to maintain a lubrication coating between the engaging surfaces in the mechanical linkage to reduce wear, spalling and metal fatigue. A top stop facilitates lash between the parts to enable proper lubrication therebetween. The mechanical linkage interacts with a plunger that is disposed within a bore formed in the fuel injector for engaging a fuel. This mechanical pressurization of the liquid fuel produces an extremely high fuel injection pressure, often exceeding 20,000 p.s.i.

In the past, designers of internal combustion engines have generally used a mechanical clamping device to hold a fuel injector on the cylinder head. One approach is to affix a clamping device having a wishbone shaped fork at one end to the cylinder head. The clamping device is bolted to the cylinder head and the forks on the wishbone shaped end contact the top surface of the fuel injector body in two places, thereby holding the fuel injector in place. A second approach is to utilize a clamping plate that engages a flange formed on the outer perimeter of the fuel injector body. The clamping plate is secured to the engine by one, or a pair of bolts, thereby drawing the flange towards the engine block and holding the fuel injector in place.

These two approaches of fastening a fuel injector to an internal combustion engine have a common limitation. The common limitation being that the mechanical clamping device imparts a concentrated clamping force to a portion of the fuel injector body. The concentrated clamping force distorts the bore formed in the fuel injector body thereby causing plunger scuffing, and ultimately the seizure of the plunger within the bore. Premature failure of the unit fuel injector is often attributed to the fuel injector body receiving a concentrated clamping load.

In order to try and solve, or at least minimize, the foregoing problem, designers have tried different approaches. For example, there have been a variety of load distribution devices conceived of over the years, for transferring static clamping loads produced by clamping devices. For example, U.S. Pat. No. 5,566,658 to Edwards et al. discloses a fuel injector top stop and load distributor for reducing the clamp load transmitted to an injector barrel from a fork clamp. The load distributor housing includes a pair of openings for receiving respective legs of the fork clamp. A top cap is threadedly attached to the load distributor housing to form a top stop for limiting the outward movement of the plunger assembly. The barrel includes a thin walled tower or cylindrical extension which functions to guide the plunger assembly. The thin walled extension also enables the top stop and load distributor housing to be securely fastened to the barrel using, for example, a groove and snap ring arrangement. The load distributor housing includes an annular ring formed on its lower surface for advantageously transferring the clamping load radially inward towards the center of neutral axis of the fuel injector body thereby resulting in a decrease in the distortion of the plunger bore in the thin walled barrel extension. However, Applicant has determined that the thin walled barrel extension is very sensitive to the clamping load and still experiences an unacceptable degree of distortion resulting in poor performance and reliability. Moreover, the top stop and load distributor must be precisely located relative to the barrel to minimize distortion thereby complicating the assembly process and increasing costs. In addition, the thin walled section of the barrel is difficult and, therefore, costly to manufacture. Likewise, the openings in the top stop and load distributor housing result in unnecessary manufacturing time and expense. In addition, the use of separate top stop components, i.e. a top stop cap and lock nut, which thread onto the load distributor housing, undesirably increases the complexity and cost of the assembly.

U.S. Pat. No. 4,601,086 to Gerlach discloses a top stop assembly, mounted on a fuel injector, which includes an annular collar having inner threads for engaging outer threads formed on the injector barrel, a top stop having outer threads for engaging the inner threads of the barrel and a locking nut for threadably engaging the outer threads of the top stop to position the top stop relative to the annular collar and the injector barrel. However, the use of separate top stop components undesirably increases the complexity and cost of the assembly. Also, the threaded connection between the annular collar and the barrel inherently necessarily creates lateral loads on the barrel possibly contributing to bore distortion.

Consequently, there is a need for a simple, inexpensive top stop assembly for a fuel injector which effectively distributes the clamping load to the injector barrel while minimizing injector bore distortion.

SUMMARY OF THE INVENTION

It is an object of the present invention, therefore, to overcome the disadvantages of the prior art and to provide a top stop assembly capable of minimizing injector bore distortion while effectively stopping the outward movement of an injector plunger assembly.

It is another object of the present invention to provide a top stop assembly which effectively distributes a clamping load to a unit fuel injector with less bore distortion thereby permitting greater clamping loads for improved high pressure sealing.

It is yet another object of the present invention to provide a top stop assembly which avoids the need for a thin walled tower or extension section of the injector barrel thereby minimizing manufacturing costs.

It is a further object of the present invention to provide a top stop assembly which avoids the use of a separate top stop cap and a separate lock nut thereby minimizing manufacturing costs and avoiding performance issues relating to the loosening of the lock nut.

It is a still further object of the present invention to provide a top stop assembly which is simple and inexpensive to manufacture.

Still another object of the present invention is to provide a top stop assembly including a top stop housing which is axisymmetric thereby inherently lowering stresses and costs.

Yet another object of the present invention is to provide a fuel injector including a top stop assembly which avoids the use of a threaded connection to the injector barrel.

A still further object of the present invention is to provide a top stop assembly which minimizes the effort required to assemble the top stop and injector barrel.

A further object of the present invention is to provide a simple, inexpensive top stop assembly which permits lubricating oil inside the top stop housing to be easily drained during operation.

It is another object of the present invention to provide a unit fuel injector and top stop assembly which transmits the clamp load towards the outer diameter of the barrel as opposed to the inner diameter of the barrel to minimize inward bore distortion, i.e. pinching, and maximize the clamping load thereby permitting use in high cylinder pressure applications while effectively sealing the fuel injector in the injector mounting bore.

These and other objects are achieved by providing a top stop assembly for receiving a clamping load from a clamp to secure a unit fuel injector, which includes a plunger assembly, to a cylinder head, comprising a unitary, single-piece top stop housing body including a central bore, a first end, an opposite second end, a clamp receiving portion formed intermediate the first and the second ends and a top stop integrally formed on the first end of the top stop housing body for restricting an axial movement of the plunger assembly. The unitary, single-piece top stop housing body further includes a threadless injector engaging portion formed on the second end for secure, threadless engagement with the unit fuel injector. The unitary, single-piece top stop housing body further includes a predetermined axial length defining a predetermined stroke of the plunger assembly. The unitary, single-piece top stop housing may be axisymmetric and the clamp receiving portion may include a cylindrical outer annular surface for guiding the clamp. Oil drain passages may be formed in the clamp receiving portion and extend radially completely therethrough. The threadless engaging portion may include an inner annular shoulder for abutment against the unit fuel injector and an annular overhang positioned radially outside the annular shoulder. The threadless engaging portion may include an aperture for receiving a roll pin for securing the top stop assembly to the unit fuel injector.

The present invention is also directed to a unit fuel injector capable of being securely mounted in a mounting bore formed in an engine cylinder head by a clamping load imparted by a clamp, comprising an injector barrel including a plunger bore, a clamped end, an opposite end and an outer surface extending between the clamped end and the opposite end. The unit fuel injector further includes a plunger assembly reciprocally mounted in the plunger bore and a top stop housing body including a central bore for receiving the clamped end of the injector barrel, a first end and an opposite end. The unit injector further includes a top stop positioned on the first end of the top stop housing body for restricting an axial movement of the plunger assembly, and a clamp receiving section positioned on the housing body intermediate the first and second ends of the top stop housing body for guiding the clamp into engagement with the top stop housing body. The unit fuel injector further includes an injector engaging device positioned on the second end of the top stop housing for engaging the injector barrel to secure the top stop housing body to the injector barrel and for transmitting the clamping load to the injector barrel. The injector engaging device includes an inner annular shoulder for abutment against the injector barrel and an annular overhang extending axially along the outer surface of the injector barrel toward the opposite end of the injector barrel. The clamp receiving section, the annular shoulder and the annular overhang may be formed integrally on the top stop housing and the clamp receiving means may include a cylindrical outer annular surface for positioning radially between the clamp and the plunger assembly. The injector engaging device may further include an annular engaging groove formed in the injector barrel and positioned adjacent the annular overhang, and a securing device positioned in the annular engaging groove to secure the housing body to the injector barrel. The injector engaging device may further include an aperture formed in the annular overhang and the securing device may be in the form of a roll pin positioned in both the aperture and the annular engaging groove. A bias spring is provided for biasing the plunger assembly into the central bore wherein the spring includes one end positioned in abutment with a distal end surface of the injector barrel. In this embodiment, the top stop may be integrally formed on the top stop housing and a predetermined axial length of the entire assembly, including the integrally formed top stop housing body, the top stop, the clamp receiving portion and the injector engaging device, may include a predetermined axial length defining a predetermined outer limit of a retraction stroke of the plunger assembly. Importantly, the injector engaging device threadlessly secures the top stop housing to the injector barrel. The injector barrel includes an outer diametrical transverse surface formed on the clamped end adjacent the outer surface of the barrel and an inner diametrical transverse surface formed on the clamped end adjacent the plunger bore. The inner annular shoulder is positioned in abutment with the outer diametrical transverse surface and the inner diametrical transverse surface is free from contact with the injector engaging device.

DETAILED DESCRIPTION OF THE PREFERRED EMBODIMENT

Figure 1:
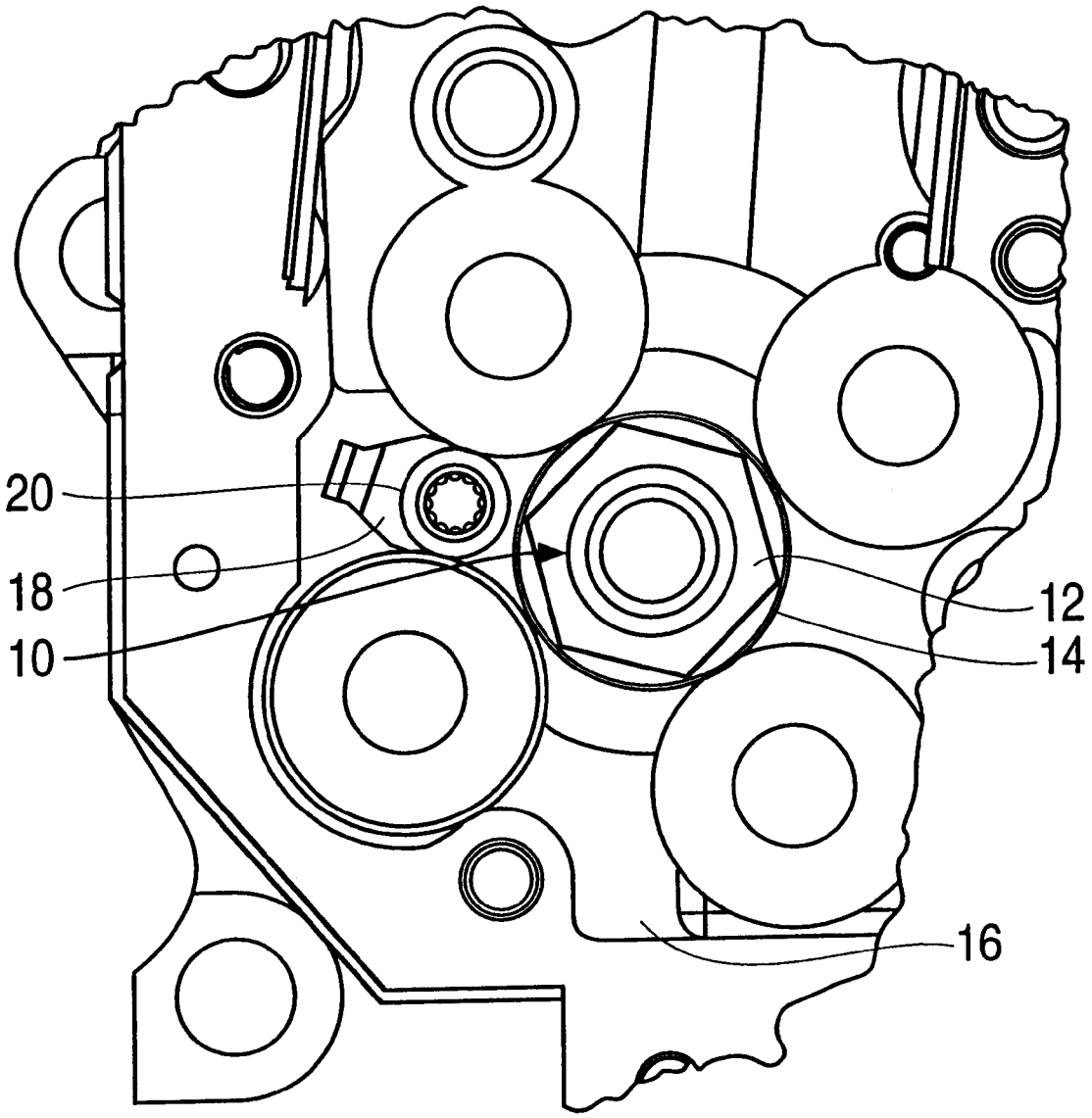
FIG. 1 is a top plane view of the top stop assembly of the present invention as mounted on a unit fuel injector secured to an engine cylinder head of an internal combustion engine by a clamp.

Referring to FIG. 1, there is shown a top stop assembly of the present invention, indicated generally at 10, which is designed to transmit high hold down clamp static loads to the body of a unit fuel injector 12 while minimizing transverse loads thereby minimizing inward fuel injector bore distortion, i.e. pinching, while effectively functioning as a top stop to limit the movement of an injector plunger assembly. Unit fuel injector 12 is positioned in a mounting bore 14 formed in a cylinder head 16 of an internal combustion engine. A clamp 18 is provided for securing unit fuel injector 12 in mounting bore 14 with a sufficient clamping load necessary to create a seal between unit fuel injector 12 and the portion of cylinder head 16 forming the inner end of mounting bore 14, sufficient to prevent cylinder gas at high cylinder pressures from leaking between the fuel injector and the cylinder head. Also, top stop assembly 10, as described hereinbelow, effectively limits the outward movement of a fuel injector plunger assembly thereby providing the necessary lash for effective lubrication of the injector drive train components. Therefore, top stop assembly 10 functions as a stop for an injector plunger assembly while effectively transmitting axial mounting loads to a fuel injector 12 in such a manner to minimize inward bore distortion thereby permitting increased clamping loads and thus improved cylinder pressure sealing.

Figure 3:
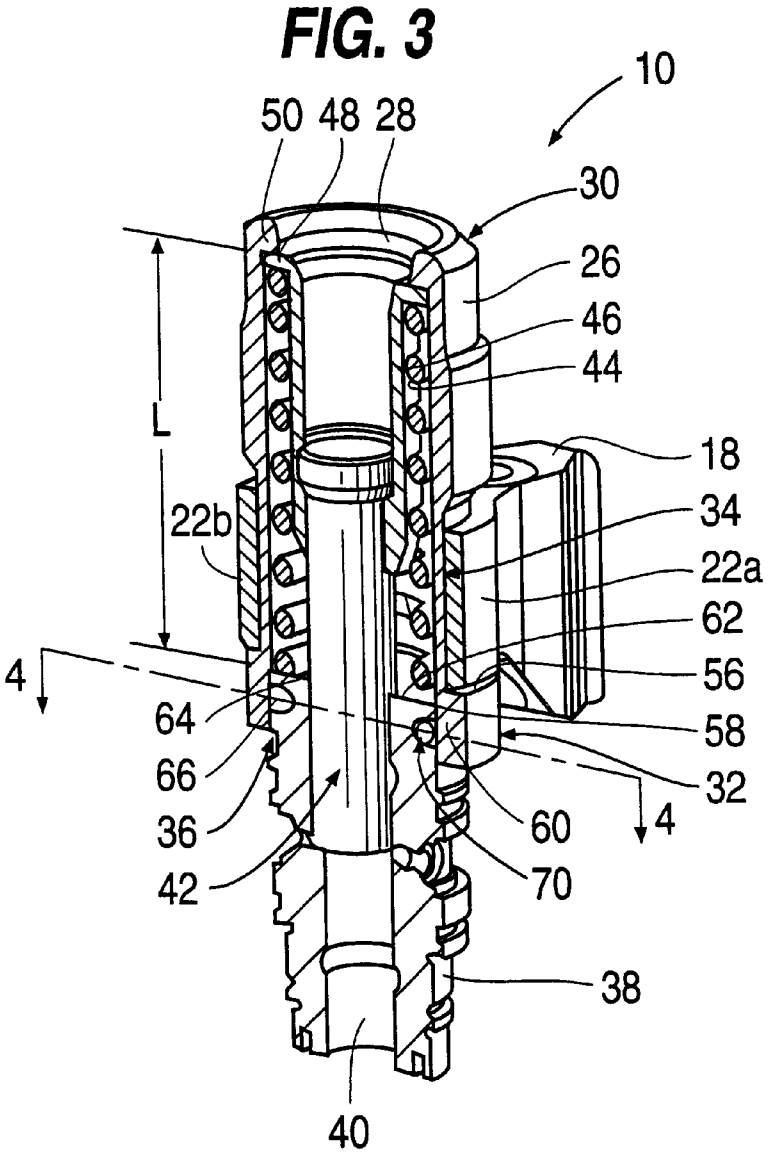
FIG. 3 is a side cross sectional perspective view of the top stop assembly, clamp and fuel injector barrel of FIG. 2.
Figure 2:
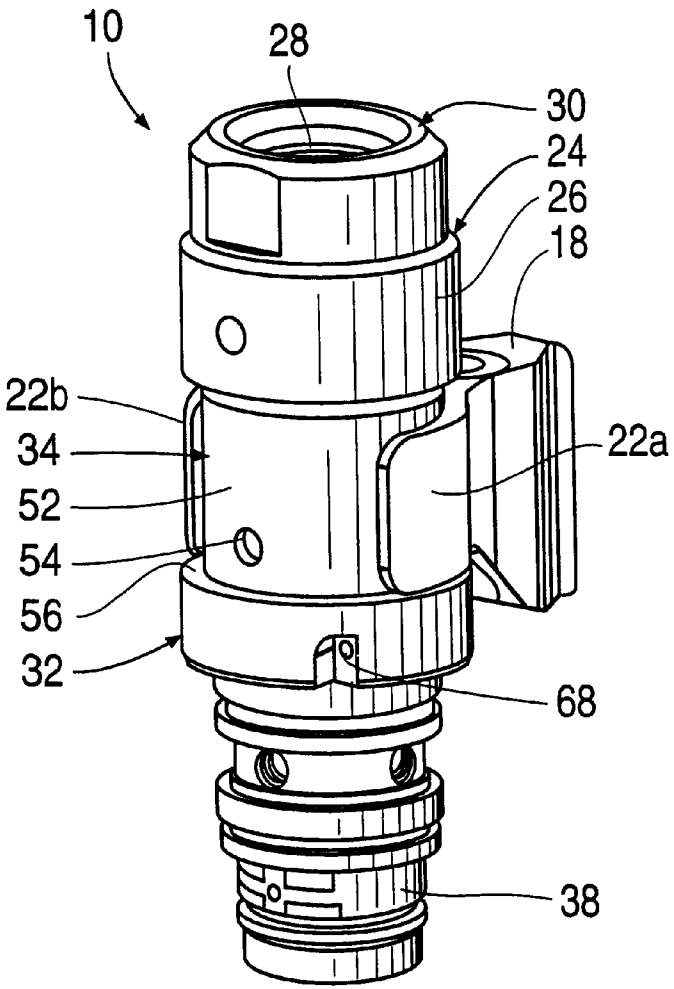
FIG. 2 is a perspective view of the top stop assembly of FIG. 1 engaged by the clamp and connected to the unit fuel injector barrel.

As shown in FIG. 1, a fastener 20, i.e. a bolt, extends through an aperture formed in clamp 18 to engage an internally threaded bore formed in cylinder head 16. As shown in FIG. 2, clamp 18 includes a pair of forks 22*a*, 22*b* formed in a spaced apart relationship with each other for engaging top stop assembly 10. The torquing of fastener 20 transmits a predetermined clamping load through forks 22*a*, 22*b* to top stop assembly 10 thereby holding unit fuel injector 12 in mounting bore 14. Referring to FIGS. 2 and 3, top stop assembly includes a unitary, single-piece top stop housing 24 including a top stop housing body 26. Top stop housing body 26 includes a central bore 28 extending completely axially therethrough, a top stop 30 positioned at one end of housing body 26, an injector engaging portion or device 32 positioned at an opposite end of housing body 26 and a clamp receiving portion 34 positioned intermediate top stop 30 and injector engaging portion 32. Injector engaging portion 32 securely engages a clamped end 36 of an injector barrel 38 without the use of threads as discussed more fully hereinbelow.

Injector barrel 38 includes a plunger bore 40 for receiving a plunger assembly 42. Plunger assembly 42 is reciprocally mounted in plunger bore 40 for movement through injection and retraction strokes. Plunger assembly 42 is biased outwardly into engagement with an injector drive train (not shown) by a bias spring 44. A coupling 46 is connected to the outer end of plunger assembly 42 and includes an outer flange and spring seat 48 against which bias spring 44 acts to bias plunger 42 outwardly. Unit fuel injector 12 may be any unit fuel injector having a plunger assembly requiring a stopping mechanism to limit the outward movement of the plunger assembly, such as any open nozzle or closed nozzle fuel injector having a mechanically operated plunger assembly, such as disclosed in U.S. Pat. Nos. 5,441,027 and 5,299,738, and co-pending patent application entitled "Pinned Injector Assembly", all commonly assigned to the applicant of the present invention and the entire contents of which are incorporated herein by reference. Of course, the injector barrel of these injector designs must be modified in accordance with the present invention to accommodate the top stop assembly of the present invention.

As shown in FIGS. 2 and 3, top stop 30 is integrally formed on housing body 26 and includes an inner annular land 50. During the retraction stroke of plunger assembly 42, annular land 50 stops the outward movement of coupling 46, and thus plunger assembly 42, by being positioned for contact by flange 48. In this manner, top stop 30 functions to facilitate lash between the parts in the injector drive train (not shown) to enable proper lubrication therebetween. Clamp receiving portion 34 is positioned intermediate the two ends of housing body 26 and includes a cylindrical outer annular surface 52 sized and positioned to guide forks 22*a*, 22*b* of clamp 18. Thus, clamp receiving portion 34 is completely devoid of large openings to allow cylindrical outer surface 52 to be positioned radially between forks 22*a*, 22*b* and plunger assembly 42. One or more small oil drain passages 54 are formed in clamp receiving portion 34 to permit lubricating oil in central bore 28 to flow outwardly into the engine overhead. In this manner, oil drain passages 54 reduce the amount of lubricating oil leaking into the fuel system through the clearance gap between plunger assembly 42 and injector barrel 38 while providing an active flow of fresh lubricating oil to the interior of housing body 26. Additional oil drain passages may be found in the injector barrel 38 to assist in draining oil from the top stop housing. Clamp receiving portion 34 also includes an annular clamping land 56 for abutment by forks 22*a*, 22*b*. The clamping load is thus transmitted by forks 22*a*, 22*b* into housing body 26 via annular clamping land 56.

Injector engaging portion 32 includes an inner annular shoulder 58 positioned in central bore 28 at an opposite end of housing body 26 from top stop 30. Injector engaging portion 32 also includes an annular overhang 60 extending from annular shoulder 58, axially along an outer surface of injector barrel 38. Annular shoulder 58 abuts a distal end surface 62 formed on injector barrel 38. Importantly, annular shoulder 58 specifically contacts an outer diametrical transverse end portion or surface 64 of distal end surface 62 as opposed to the inner diametrical transverse end portion or surface of distal end surface 62. Preferably, distal end surface 62 is positioned in, and extends through, a single transverse plane from plunger bore 40 to the outer surface of injector barrel 38. This design avoids a thin-walled inner diametrical extension or tower section extending into central bore 28 thereby avoiding the inward bore distortion problems associated with such thin-walled towers. When top stop housing 24 is mounted on injector barrel 38 and a clamping load is applied to annular clamping land 56, the clamping load is transferred to injector barrel 38 at the outer diameter of injector barrel 38 by the contact between inner annular shoulder 58 and outer diametrical surface 64. By imparting the clamping load on the outer portion of injector barrel 38, and avoiding a threaded connection as discussed hereinbelow, top stop housing 24 of the present invention minimizes the barrel inward bore distortion while permitting greater clamping forces required in higher cylinder pressure applications.

Figure 4:
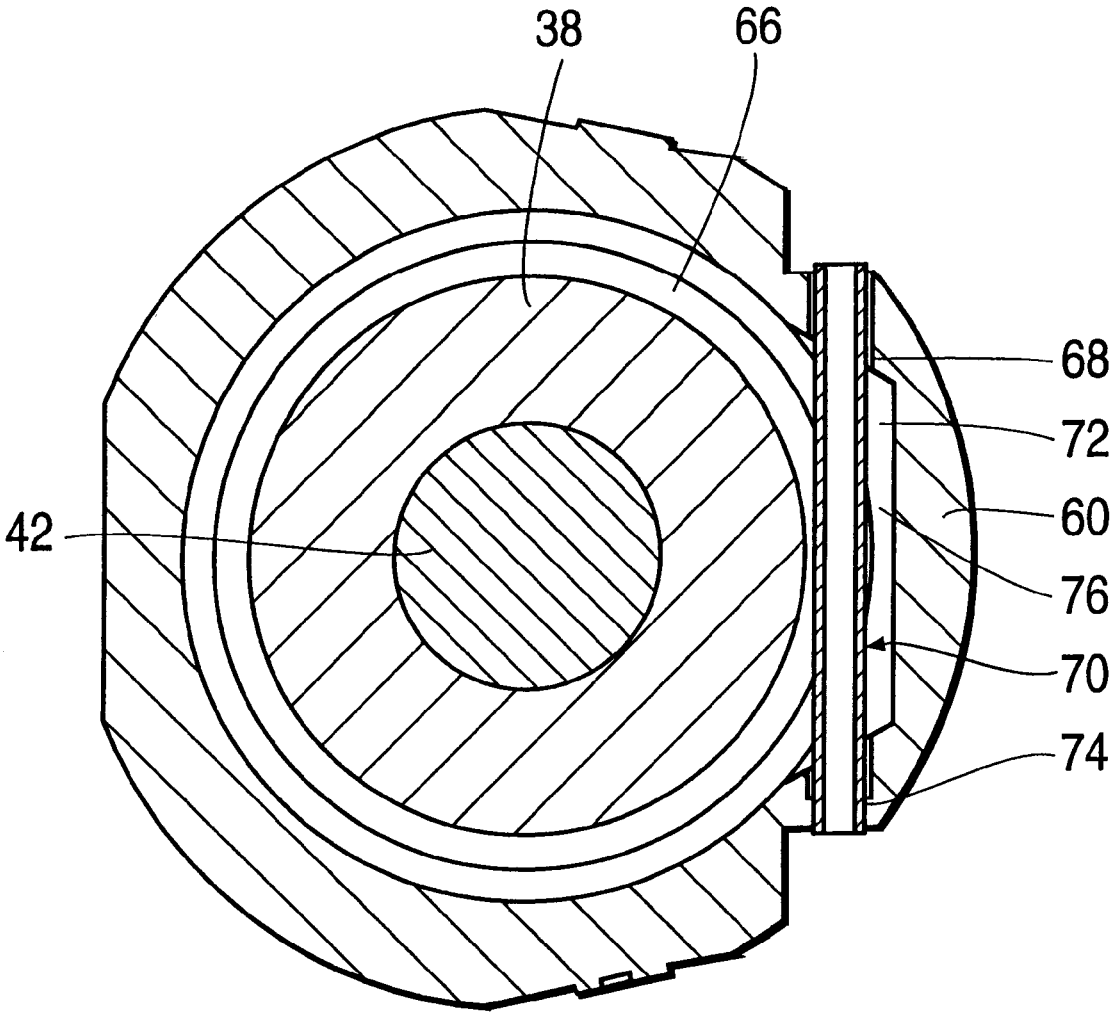
FIG. 4 is a cross sectional view of the unit injector taken along plane 4—4 in FIG. 3.

As shown in FIGS. 3 and 4, injector barrel 38 includes an annular engaging groove 66 formed in the outer surface of injector barrel 38 at clamped end 36. An aperture 68 is formed in annular overhang 60 for receiving a securing device 70, i.e. a roll pin, for securing top stop housing 24 to injector barrel 38. Pin 70 is preferably a coiled roll pin designed to ensure adequate strength, especially during injector removal. Aperture 68 extends through annular overhang 60 in a tangential relationship to annular engaging groove 66 to permit the insertion of roll pin 70 through aperture 68 into annular engaging groove 66 to create a relatively loose yet secure threadless connection between top stop housing 24 and injector barrel 38. Referring to FIG. 4, importantly, pin aperture 68 includes a slip fit portion 72 extending from one end along a substantial portion of aperture 68 and a press fit portion 74 formed at an opposite end. Slip fit portion 72 is formed with a diameter slightly larger than the diameter or width of pin 70 to permit pin 70 to be easily inserted through slip fit portion 72. On the other hand, press fit portion 74 is formed with a diameter slightly less than the diameter of pin 70 to create an interference, or press, fit between one end of pin 70 and press fit portion 74. Another important aspect of the present threadless injector engaging portion or device 32 is the relative sizing of annular groove 66, aperture 68 and pin 70. In conventional fuel injector body designs, a top stop assembly is connected to an injector barrel via a threaded connection which places transverse loads on the barrel thereby inwardly distorting the central bore and causing plunger scuffing. The present threadless injector engaging portion or device 32 avoids placing transverse assembly loads on barrel 38 by not only avoiding a threaded connection and engaging the outer diameter of barrel 38, but also by sizing annular groove 66 and aperture 68 to form a cavity 76 having a peripheral extent greater than the diameter of pin 70. Thus, the transverse assembly loads at this connection are completely avoided by sizing cavity 76 with a peripheral extent large enough to avoid pressed contact with pin 70. Injector engaging portion 32 effectively connects top stop housing 24 to injector barrel 38 without the use of screw threads thereby eliminating transverse loads associated with threaded connections. As a result, the threadless engaging portion 32 creates a relatively loose and completely threadless connection during assembly while permitting clamp 18 to create a secure, fixed connection by transmitting an axial clamping load to the housing. This design greatly minimizes inward bore distortion thereby reducing plunger scuffing and the likelihood of injector failure. It should be understood that the threadless injector engaging portion or device 32 of the present invention may use more than one pin and aperture combination, or any other connection capable of attaching top stop housing body 26 and barrel 38 while avoiding imparting a transverse load to barrel 38.

Importantly, housing body 26 is formed symmetrically around its longitudinal axis, i.e. axisymmetric, to avoid the need to precisely position housing body 26 in a particular rotative position for proper operation. Thus, top stop housing body 26 is attached to the injector barrel 38 at any rotative position, as described more fully hereinbelow, and then engaged by clamp 18 irrespective of the rotative position of housing body 26 while automatically positioning top stop 30 for effective top stop operation. Also, pin 70 will engage annular groove 66 regardless of the relative rotative position between top stop housing body 26 and barrel 38 since annular groove 66 extends around the entire circumference of barrel 38. The axisymmetric design also inherently reduces stress in the housing.

Unitary, single-piece top stop housing 24 is designed with a predetermined axial length L, indicated in FIG. 3, which positions annular land 50 at a predetermined stop position thereby defining a predetermined outer limit of the retraction stroke of plunger assembly 42. Predetermined axial length L is the length of the housing 24 between inner annular shoulder 58 and annular land 50. The "top stop" or predetermined outer limit of the retraction stroke is set by selecting a top stop housing having a predetermined axial length L which defines a desired top stop position, i.e. an outer limit of the retraction stroke of the plunger assembly 42, which creates the desired lash between the components of the injector drive train (not shown) necessary to maintain lubricating oil between the parts for proper lubrication. This preset top stop feature associated with each unitary, single-piece top stop housing 24 is achieved by forming top stop 30 and injector engaging portion 32 integrally with housing body 26 to create the unitary, single-piece top stop housing 24. In this manner, the top stop housing of the present invention avoids the unnecessary costs of providing separate top stop components, such as a top stop cap and a lock nut, while avoiding the problems associated with the loosening of separate components connected by threaded connections.

INDUSTRIAL APPLICABILITY

The top stop assembly of the present invention may be used on any fuel injector having a reciprocally mounted plunger assembly, i.e. a mechanically actuated unit fuel injector, mounted on any combustion engine of any vehicle or industrial equipment in which accurate, inexpensive and effective top stop functioning and load distribution is essential.

We claim:

1. A top stop assembly for receiving a clamping load from a clamp to secure a unit fuel injector, which includes a plunger assembly, to a cylinder head, comprising:

a unitary, single-piece top stop housing body including a central bore, a first end, an opposite second end, a clamp receiving portion formed intermediate said first and said second ends, a top stop integrally formed on said first end of said body for restricting an axial movement of the plunger assembly, and a threadless injector engaging portion formed on said second end for secure, threadless engagement with the unit fuel injector.

2. The top stop assembly of claim 1, wherein said unitary, single-piece top stop housing body includes a predetermined axial length defining a predetermined outer limit of a retraction stroke of the plunger assembly.

3. The top stop assembly of claim 1, wherein said unitary, single-piece top stop housing is axisymmetric and said clamp receiving portion includes a cylindrical outer annular surface for guiding the clamp.

4. The top stop assembly of claim 3, further including oil drain passages extending radially completely through said clamp receiving portion.

5. The top stop assembly of claim 4, wherein said threadless injector engaging portion includes an inner annular shoulder for abutment against the unit fuel injector and an annular overhang positioned radially beyond said annular shoulder.

6. The top stop assembly of claim 5, wherein said threadless injector engaging portion includes an aperture for receiving a roll pin for securing said top stop assembly to the unit fuel injector.

7. A top stop assembly for receiving a clamping load from a clamp to secure a unit fuel injector, which includes a plunger assembly, to a cylinder head, comprising:

an axisymmetric housing body including a central bore, a first end and an opposite second end;

a top stop positioned on said first end of said housing body for restricting an axial movement of the plunger assembly;

a cylindrical clamp receiving portion positioned on said housing body intermediate said first and said second ends, said clamp receiving portion including an outer annular surface extending between the clamp and the plunger assembly; and a threadless injector engaging means formed on said second end for threadlessly engaging the unit fuel injector to secure said housing body to the unit injector.

8. The top stop assembly of claim 7, wherein said top stop is integrally formed on said axisymmetric housing body.

9. The top stop assembly of claim 8, wherein said axisymmetric housing body and said integrally formed top stop include a predetermined axial length, said predetermined axial length defining a predetermined outer limit of a retraction stroke of the plunger assembly.

10. The top stop assembly of claim 8, further including oil drain passages extending radially completely through said clamp receiving portion.

11. The top stop assembly of claim 7, wherein said threadless injector engaging means includes an inner annular shoulder for abutment against the unit fuel injector and an annular overhang positioned radially beyond said annular shoulder.

12. The top stop assembly of claim 8, wherein said threadless injector engaging portion includes an aperture for receiving a roll pin for securing said top stop assembly to the unit fuel injector.

13. A unit fuel injector capable of being securely mounted in a mounting bore formed in an engine cylinder head by a clamping load imparted by a clamp, comprising:

an injector barrel including a plunger bore, a clamped end, an opposite end and an outer surface extending between said clamped end and said opposite end;

a plunger assembly reciprocally mounted in said plunger bore;

a top stop housing body including a central bore for receiving said clamped end of said injector barrel, a first end and an opposite second end;

a top stop positioned on said first end of said top stop housing body for restricting an axial movement of said plunger assembly;

a clamp receiving means positioned on said housing body intermediate said first and said second ends of said top stop housing body for guiding the clamp into engagement with said top stop housing body;

an injector engaging means positioned at said second end of said top stop housing for engaging said injector barrel to secure said top stop housing body to said injector barrel and for transmitting the clamping load to said injector barrel, said injector engaging means including an inner annular shoulder for abutment against said injector barrel and an annular overhang extending axially along said outer surface of said injector barrel toward said opposite end of said injector barrel.

14. The unit fuel injector of claim 13, wherein said clamp receiving means, said inner annular shoulder and said annular overhang are formed integrally on said top stop housing body and said clamp receiving means includes a cylindrical outer annular surface for positioning radially between the clamp and said plunger assembly.

15. The unit fuel injector of claim 13, wherein said clamped end of said injector barrel includes a distal end surface, said inner annular shoulder engaging said distal end surface.

16. The unit fuel injector of claim 13, wherein said injector engaging means further including an annular engaging groove formed in said injector barrel and positioned adjacent said annular overhang, said injector engaging means further including a securing device positioned in said annular engaging groove to secure said housing body to said injector barrel.

17. The unit fuel injector of claim 16, wherein said injector engaging means further includes an aperture formed in said annular overhang and said securing device includes a roll pin positioned in said aperture and said annular engaging groove.

18. The unit fuel injector of claim 15, further including a bias spring for biasing said plunger assembly into said central bore, said spring including one end positioned in abutment with said distal end surface.

19. The unit fuel injector of claim 13, wherein said top stop is integrally formed on said top stop housing body, said integrally formed top stop housing body, said top stop, said clamp receiving portion and said injector engaging means including a predetermined axial length, said predetermined axial length defining a predetermined outer limit of a retraction stroke of said plunger assembly.

20. The unit fuel injector of claim 13, wherein said injector engaging means threadlessly secures said top stop housing to said injector barrel, said injector barrel including an outer diametrical end surface formed on said clamped end adjacent said outer surface of the said barrel and an inner diametrical end surface formed on said clamped end adjacent said plunger bore, said inner annular shoulder positioned in abutment with said outer diametrical end surface, said inner diametrical end surface being free from contact with said inner annular shoulder.

* * * * *